United States Patent [19]

Wixon

[11] Patent Number: 4,971,706

[45] Date of Patent: Nov. 20, 1990

[54] FABRIC SOFTENING COMPOSITION

[76] Inventor: Harold E. Wixon, 10 Landing La., New Brunswick, N.J. 08901

[21] Appl. No.: 324,960

[22] Filed: Mar. 20, 1989

Related U.S. Application Data

[63] Continuation of Ser. No. 102,762, Sep. 24, 1987, abandoned, which is a continuation of Ser. No. 892,637, Aug. 4, 1986, abandoned.

[51] Int. Cl.[5] ..... D06M 13/24

[52] U.S. Cl. ..... 252/8.6; 252/108; 252/135; 252/174.21; 260/414

[58] Field of Search ..... 252/8.6, 8.7, 108, 133, 252/135, 174.21, 369, 370, 35, 36, 38, 39; 260/414, 417

[56] References Cited

U.S. PATENT DOCUMENTS

| | | | |
|---|---|---|---|
| 2,413,220 | 12/1946 | Elder et al. | 252/39 |
| 4,006,091 | 2/1977 | Lindblom et al. | 252/160 |
| 4,073,735 | 2/1978 | Ramachamdran | 252/8.6 |
| 4,139,479 | 2/1979 | Goffinet et al. | 252/8.6 |
| 4,436,637 | 3/1984 | Ramachandran et al. | 252/8.7 |

FOREIGN PATENT DOCUMENTS

| | | |
|---|---|---|
| 3017121 | 11/1981 | Fed. Rep. of Germany . |
| 657815 | 9/1951 | United Kingdom . |

*Primary Examiner*—Paul R. Michl
*Assistant Examiner*—Hoa Van Le

[57] ABSTRACT

A liquid fabric softening composition comprising a predispersed finely-divided divalent and/or trivalent metal soap homogeneously suspended in an aqueous dispersing medium; the process of preparing said liquid fabric softener; and a method of softening fabrics therewith.

11 Claims, No Drawings

FABRIC SOFTENING COMPOSITION

This application is a continuation of application Ser. No. 102,762 filed Sept. 24, 1987, now abandoned which is a continuation of application Ser. No. 892,637 filed Aug. 4, 1986, now abandoned.

BACKGROUND OF THE INVENTION AND PRIOR ART

This invention relates to liquid fabric treating compositions capable of imparting softness to fabrics treated therewith, particularly in the rinse cycle of the laundering procedure, containing small amounts of di- and/or tri-valent metal soaps as the fabric softening agent.

Both textile processing and household laundering of fabrics require modifying agents to impart softness and pleasant feel of "hand" (smooth, pliable and fluffy) to the washed fabrics. The cationic, particularly the quaternary ammonium compounds are well known in the art as effective fabric softeners However, they have the disadvantages of causing yellowing of the fabrics treated therewith, and of complexing with the residual anionic detergent materials used in the washing cycle which decreases its efficacy as a softening agent. British Patent No. 1,456,913 and U.S. Pat. No. 3,920,565 have addressed these problems by providing a fabric softener composition comprising a mixture of a cationic fabric softener and an alkali metal soap which contributes to the softening function at low level usage.

U.S. Pat. No. 4,329,237 and No. 4,411,803 also discloses the combination of a water-soluble fatty acid soap and a quaternary softener as the softening agents in a detergent softener composition.

The prior art further discloses softening compositions containing a cationic softener, particularly the quaternary compounds, as the primary softening agent in combination with a modifying agent to improve its softening properties, as disclosed in U.S. Pat. No. 4,000,077, wherein the combination of a quaternary and an alcohol sulfate is used. U.S. Pat. No. 4,118,327 discloses the combination of a quaternary with a Phosphoric acid ester. U.S. Pat. No. 4,426,304 discloses the combination of a quaternary compound and a partially oxidized polyethylene or a fatty amphoteric compound as the softening agent. British Patent No. 1,408,787 discloses a combination of a quaternary compound and an oil or an alkyl ester of a long chain fatty acid. British Patent No. 1,576,326 and U.S. Pat. No. 4,139,479 disclose a textile treating rinse composition having softening properties comprising the combination of a cationic surfactant such as a quaternary compound and a water-insoluble soap.

Anionic fabric softeners are also known in the art and include soaps, sulfonated oils, sulfated castor oil, fatty alcohol sulfates and anionic emulsions of fats, oils or waxes 1 using soaps or fatty alcohol sulfates as emulsifiers, as disclosed in *Soap/Cosmetics/Chemical Specialties* for July, 1978, pp. 25–27. However, the anionics have limited durability, require higher treatment levels, are sensitive to water hardness (the calcium and magnesium in tap water), low pH and various electrolytes. These disadvantages have limited their use to textile processing applications. It is known that large amounts of sodium soap solutions of sodium or potassium soaps are added to tap water, a curd of calcium and magnesium soaps forms. This curd adheres to fabric and gives a soft hand which varies with the soap concentration. However, this curd is undesirably slimey and unsightly on the fabric, and the calcium soap in the curd are in the form of large particles. British Patent No. 1,329,416 discloses a particulate detergent composition having softening properties comprising a synthetic detergent active compound and 2–25% of a water-insoluble soap in the form of aggregate of particles of less than 2 microns. Water-insoluble soaps have also been used in conjunction with bentonite as the softening agent in a detergent softening composition or in a rinse cycle softening composition as disclosed in U.S. Pat. No. 4,436,637 and No. 4,472,287.

However, a liquid fabric softening composition consisting essentially of a predispersed, finely divided di- and/or tri- valent metal soap as an additive in the rinse cycle of the laundering operation is not disclosed.

SUMMARY OF THE INVENTION

It has now been found that relatively low concentrations of di- and tri- valent metal soaps in aqueous dispersion give unexpectedly good softening effects without the yellowing exhibited by quaternaries.

Accordingly, it is an object of the present invention to provide a fabric softening composition devoid of yellowing tendencies containing low concentrations of a finely divided, dispersible divalent or trivalent metal soap, and to the process of preparing said liquid fabric softener.

It is a further object of the present Invention to provide a liquid fabric softening composition having particular utility in the rinse cycle of a laundering operation.

Another object of present invention is to provide a dilute or concentrated fabric softening composition possessing superior softening properties.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, the liquid fabric softening composition of this invention consists essentially of an effective softening amount of predispersed, finely divided divalent or trivalent metal soaps homogeneously suspended in an aqueous dispersing medium; and the method of softening fabrics which comprises contacting washed fabrics with said composition during the rinse cycle of the laundering operation; and the process of preparing said liquid rinse cycle fabric softener composition concurrently with the in situ preparation of the predispersed metal soap which comprises separately preparing an aqueous solution of an alkali metal fatty acid soap in deionized water, and an aqueous solution of a divalent and/or trivalent metal salt in deionized water, admixing said metal salt solution with said soap solution to convert said soap into said metal soap, and recovering a finely divided predispersed metal soap in a deionized aqueous medium. The metal soap is preferably prepared in situ, in the presence of the ingredients of the final composition. The predispersed metal soap may also be separately prepared by reacting a dilute soap solution in deionized water with a diluted metal salt solution in deionized water to yield an aqueous dispersion of a metal soap. Said dispersion is subsequently added to the softening composition.

More specifically, present invention relates to a stable liquid rinse cycle softening composition consisting essentially of a predispersed finely divided metal soap selected from the group consisting of calcium, magnesium, aluminum and zinc soaps of saturated or unsaturated fatty acids containing 10 to 24 carbon atoms, and mixtures thereof, in a deionized aqueous medium.

The di- and tri- valent metal soaps utilized in present novel fabric rinse softener composition may be defined as a water insoluble metal soap, wherein the carboxylic acid may be saturated or unsaturated, straight or branched-chain containing 10 to 24 carbon atoms, and my be derived from natural fats and oils such as coconut, palm, palm kernel, babassu, tallow, etc. Commercial fatty acids are usually mixtures of fatty acids. Suitable carboxylic acids include decanoic, lauric, myristic, palmitic, oleic, stearic, heptadecanoic, monodecanoic, and mixtures thereof. The preferred metal soaps are selected from the group consisting of calcium, magnesium, aluminum and zinc salts of a fatty acid or mixture of fatty acids containing 10 to 24 carbon atoms. Particularly useful metal soaps herein are zinc, aluminum, magnesium, and calcium cocoate; zinc, aluminum, magnesium, and calcium tallowate, and mixtures thereof.

The water insoluble soaps of the invention are predispersed in a deionized aqueous dispersing medium in order to provide a finely divided, homogeneous, stable suspension in an aqueous dispersing medium, which rapidly disperses in cold as well as warm rinse water. Softness is a function of the dispersibility of the softening agent. The finely divided particles of the metallic soap penetrates fabrics and fibers evenly, and provides an excellent softness to the fabric treated therewith. The metal soaps in powdered form do not disperse rapidly in the rinse water.

The metal soap dispersion utilized in present invention is prepared by reacting a water soluble soap dissolved in a deionized aqueous medium, with a water soluble divalent or trivalent metal salt dissolved in a deionized aqueous medium, to cause precipitation of finely divided, about 2 to 4 microns, dispersible metallic soap, homogeneously dispersed in a deionized aqueous medium. More specifically, a dilute aqueous soluble soap solution is prepared by reacting sodium or potassium hydroxide with the selected fatty acid, or mixtures thereof, and is then reacted with a separately prepared aqueous salt solution of the desired metal to cause precipitation of the metallic soap in the aqueous medium. The soap solution and the salt solution may be reacted at room temperature or at elevated temperatures of 110°-120° F. The predispersed metallic soap dispersion is preferably formed in situ during the preparation of the liquid fabric softening composition. Not all of the sodium soap may be converted to the metal soap. The amount of conversion depends on the concentrations of the metal salt and the soap reactants. A conversion of at least 50% is required, by adjusting the concentration of the reactants. Thus, the softening composition of this invention may comprise unreacted sodium soap and a metal soap in a ratio of 1:1.5 respectively, and the unreacted sodium soap may help disperse and suspend the metal soap. The unreacted sodium soap becomes calcium and/or magnesium soap when it reacts with the hardness in the rinse water.

The amount of metallic soap should be sufficient to soften fabrics in the absence of known softening agents such as cationic quaternary ammonium softening agents, and constitutes about 1 g to 20 g AI (Active Ingredient) metal soap per 3000 g. of fabric per rinse treatment, and preferably about 1.5 g to 10 g A.I. metal soap, and most preferred about 3 g to 8 g A.I. metal soap. It is preferred to use 6 g. for full size washer loads which holds 3000 g of fabric (1 g metal soap:500 g fabric=2%); and 3 g. for small loads and hand washing. The volume of the liquid softener composition varies from about 10 mls. to 120 mls. (½ cup), Therefore, the percentage of metal soap in the liquid composition is about 2-80% and preferably about 3-60% by wt, when in ready to use, dilute form. However, the liquid softening composition may also be in concentrated form for dilution at home. In the concentrated form, the rinse cycle softener composition contains about 20-60% A.I. metal soap.

A clean load softening test was conducted using 6 lbs. mixed laundry items including towels, shirts, T-shirts, blouses, etc.; and three new terrycloth wash cloths, 15×13 inches (84% cotton/16% polyester), washed in 17 gallons water, 100 ppm hardness, in GE washer at 120° F. wash cycle and cool rinse setting, with 80 g powdered anionic detergent having the following formulation:

| Powdered Anionic Detergent | % A.I. |
|---|---|
| Linear Tridecylbenzene Sulfonate (LTBS) | 15 |
| Sodium Tripolyphosphate | 26 |
| Sodium Silicate | 7 |
| Sodium Carboxymethyl Cellulose | 0.1 |
| Hydroxypropyl Methyl Cellulose | 0.5 |
| Optical Brightener | 0.2 |
| Sodium Sulfate, Impurities, Moisture | Q.S. |

The softeners are added in the rinse cycle as agitation begins. The loads are dried in a dryer and the wash cloths are rated for softness on a scale of 1 to 10, no softness to excellent softness. When softness (fluffiness, smoothness and lubricity) is better than 10, a 10+ rating is assigned. The standard 10 softness evaluation is based on 60 g of a typical quaternary ammonium rinse cycle softener, commercially available and having the following ingredients:

| Softener | % A.I. |
|---|---|
| Di-Hydrogenated Tallow Dimethyl Ammonium Chloride | 5.0 |
| Water and Impurities | 95.0 |

As shown in Table I, softness varies significantly with metal ion and with the ratio of tallow/coco soap stock. 60 g of a 10% metal soap dispersion containing 1% $C_{12}$-$C_{15}$ alcohol EO7:1 was added to the rinse cycle.

TABLE I

RINSE CYCLE SOFTENER

| | Softness *Tallow/Coco Ratio | | |
|---|---|---|---|
| Metal | 75/25 | 60/40 | 0/100 |
| Calcium | 9 | — | — |
| Magnesium | 9 | — | — |
| Aluminum | 7 | 8 | 9 |
| Zinc | 6 | 10 | 10+ |

TABLE I-continued

| RINSE CYCLE SOFTENER | Softness *Tallow/Coco Ratio | | |
|---|---|---|---|
| Metal | 75/25 | 60/40 | 0/100 |
| Sodium | 4 | — | 3 |

*Tallowate ($C_{14-18}$)
Cocoate ($C_{12-14}$)

Using the softener in multiple cycles enhances the softness of the fabrics treated therewith as shown in Table II.

TABLE II

| RINSE CYCLE SOFTENER | Softness | |
|---|---|---|
| | 1 Cycle | 3 Cycles |
| 7.5% of Ca Soap | 9 | 10 |
| 7.5% of Mg Soap | 9 | 10 |
| 10% Al Soap | 7 | |
| 10% Zn Soap | 6 | |

Soap Stock: 75 Tallow/25 Coco

The softening composition of the present invention may also include minor amounts of about 0.25 to 5% by weight of conventional optional ingredients such as brighteners, bluings, germicides, surfactants to help disperse and suspend the metal soaps including anionic, i.e. sodium soaps, nonionic, i.e. ethoxylated higher aliphatic alcohols, and amphoteric surfactants; solvents including alcohols and glycols such as propylene glycol and hexylene glycol; viscosity control agents such as tripolyphosphate, pyrophosphate, and hydrotropes such as sodium xylene sulfonate, provided they do not interfere with the softening activity of the composition.

The method of softening fabrics in accordance with present invention comprises contacting fabrics in a cold or warm aqueous medium with an aqueous fabric softener composition comprising a predispersed, finely divided divalent and/or trivalent metal soap to provide a ratio of from 1 g to 20 g metal soap softening agent per 3000 g of fabric.

More specifically, the process of softening fabrics comprises adding to the water in the rinse cycle of the laundering operation, a fabric softening composition comprising about 3–60% by weight of a divalent and/or trivalent metal soap in an aqueous carrier, per rinse treatment.

DETAILED DESCRIPTION OF THE INVENTION

The following examples are merely illustrative of the invention and are not to be construed as limiting thereof.

EXAMPLE 1

| Softener Composition Containing Zinc Cocoate | % |
|---|---|
| Part I | |
| Deionized Water | 67.1 |
| Distilled Coconut Oil Fatty Acids ($C_{12-14}$) | 8.0 |
| Sodium Hydroxide, 50% Soln | 3.0 |
| C12–15 Alcohol EO 7:1 | 0.6 |
| Sandolan Blue, 1% Soln | 0.5 |
| | 79.2 |
| Part II | |
| Deionized Water | 16.5 |

-continued

| Softener Composition Containing Zinc Cocoate | % |
|---|---|
| Zinc Sulfate Heptahydrate | 3.0 |
| Pentasodium Tripolyphosphate | 0.5 |
| | 20.0 |
| Part III | |
| Perfume | 0.4 |
| C12–15 Alcohol EO 7:1 | 0.4 |
| | 0.8 |
| | 100.00 |

Process (1) Parts I and II are heated to 110°–120° F.
(2) Part iI is added to Part I with vigorous agitation.
(3) After cooling to 90° F. or below, Part III is added.
ph is 6.8. Viscosity is about 100 cps.
Softness Rating is 10+

In this composition, the function of tripolyphosphate is to control viscosity and facilitate dispersion in cold rinse water. Without tripolyphosphate, viscosity is very high, e.g. 16000 cps (non-pourable). Pyrophosphate may be substituted for the tripolyphosphate. The ethoxylated alcohol aids dispersion of the zinc cocoate as it is formed during processing and aids emulsification of the perfume oils.

In this composition, the ratio of zinc cocoate to sodium cocoate is about 1.5:1. Higher ratios may be obtained by increasing the zinc sulfate concentration or lowering the coconut fatty acid concentration.

EXAMPLES 2 AND 3

| High Ca Soap Formulas | 2 | 3 |
|---|---|---|
| Part I | | |
| Sodium Soap (75/25)* | 20 | 30 |
| C12–15 Alcohol EO 7:1 | 2 | 3 |
| Water, Deionized | 64 | 41 |
| Part II | | |
| Calcium Chloride | 4 | 6 |
| Water, Deionized | 10 | 20 |
| | 100 | 100 |
| Usage in Rinse | 20 g | 20 g |
| Softness Ratings | 9 | 10 |

*Tallow (C16–18)/Coco (C12–14) Ratio

When Ca soap content is 20% or more, some alcohol is used to reduce viscosity. In Example 3 above, the addition of 5% ethanol gives a low viscosity. Ratio of calcium tallowate/cocoate to sodium tallowate/cocoate is about 1.5:1.

EXAMPLE 4

| | % |
|---|---|
| Part 1 | |
| 75/25 Soap Chips* | 10 |
| C12–15 Alcohol EO 7:1 | 1 |
| Deionized Water | 79 |
| Part II | |
| $CaCl_2 \cdot 2H_2O$ | 1 |
| Deionized Water | 9 |
| | 100 |

*Mixture of 75% Tallowate (C16–18) 25% Cocoate (C12–14)

Softness Rating:

Ratio of calcium tallowate/cocoate to sodium tallowate/cocoate is about 1:1.

Rinse Cycle Softeners

EXAMPLES 5-11

RINSE CYCLE SOFTENERS
Examples 5-11
10% Na Cocoate (~9% Anhydrous)*

| | % Zn Cocoate | Softness 30 g | Softness 60 g | Viscosity (24 Hours) |
|---|---|---|---|---|
| 5 1% $ZnSO_4.H_2O$ | 25-30 | 8 | 9 | Very Low |
| 6 2% $ZnSO_4.H_2O$ | 50-60 | 10 | 10+ | High |
| 7 3% $ZnSO_4.H_2O$ | 75-85 | 10 | 10+ | Very High |
| 8 1% $ZnCl_2$ | 35-40 | 10 | 10+ | Very Low |
| 9 2% $ZnCl_2$ | 70-80 | 10 | 10+ | Very High |
| 10 1% $ZnSO_4.H_2O$ 1% $Al_2(SO_4)_3.nH_2O$ | | — | 10 | Very Low |
| 11 5% Quat (Control) | 9 | 10 | | |

*Sirena Brand Coconut Oil Soap, Mexico; Used as Is (Est. 90% Anhydrous).

Increasing the metal salt yields a greater conversion into the metal soap. In the rinse water, unreacted Na cocoate becomes Ca/Mg Cocoate. Not all of the sodium soap is converted to the metal soap as shown above. .It is also noted that a conversion of at least 50% yields superior softness values in comparison to the quaternary softener used as a control. The unreacted sodium soap may help disperse and suspend the metal soap, the perfume and any other additives in the composition. The unreacted sodium soap becomes calcium and/or magnesium soap when it reacts with the hardness in the rinse water.

Present rinse cycle fabric softener compositions exhibit greater softening efficacy than the quaternaries, as shown in Example 11, without the yellowing often associated with the quaternaries.

It is understood that the foregoing detailed description is given merely by way of illustration and that variations may be made therein without departing from the spirit of the inventor. The "Abstract" given above is merely for the convenience of technical searchers and is not to be given any weight with respect to the scope of the invention.

What is claimed is:

1. A stable non-yellowing liquid fabric softening composition free of quaternary ammonium fabric softeners, consisting essentially of about 3-60% by weight of a predispersed precipitated, finely divided divalent or trivalent metal soap as the non-yellowing softening agent, homogeneously suspended in a deionized aqueous dispersing medium.

2. A composition according to claim 1, wherein the metal soap is selected from the group consisting of calcium, magnesium, aluminum and zinc soaps of saturated and unsaturated fatty acids containing 10 to 24 carbon atoms, and mixtures thereof, dispersed in a deionized aqueous medium.

3. A composition according to claim 2, wherein the metal soap is zinc cocoate.

4. A composition according to claim 2, wherein the metal soap is a mixture of zinc cocoate and zinc tallowate.

5. A composition according to claim 2, wherein the metal soap is a mixture of calcium cocoate and calcium tallowate.

6. A composition according to claim 1, wherein the predispersed, precipitated metal soap is prepared in situ by reacting a dilute water soluble soap solution in deionized water with a dilute di- or tri- metal salt solution in deionized water to form an aqueous dispersion of said finely divided di- or tri- metal soap.

7. A composition according to claim 1, additionally containing 0.25-5% of an ethoxylated alcohol.

8. A composition according to claim 1, additionally containing 0.25-5% pentasodium tripolyphosphate.

9. A composition according to claim 6, wherein at least 50% of the soap is converted into the finely divided, dispersible metal soap.

10. A composition according to claim 6, containing a mixture of unreacted water soluble soap and said divalent and/or trivalent metal soap, in the ratio of 1:1.5 of water soluble soap: metal soap.

11. The composition according to claim 1, which is an additive in the rinse cycle of the laundering operation.

* * * * *